US012716585B2

(12) United States Patent
Hugues Dit Ciles

(10) Patent No.: US 12,716,585 B2
(45) Date of Patent: Aug. 25, 2026

(54) METHOD FOR REGULATING A PELLET-FIRED BURNER AND CORRESPONDING INSTALLATION

(71) Applicant: N2AIR, Mantry (FR)

(72) Inventor: Jérémy Hugues Dit Ciles, Mantry (FR)

(73) Assignee: N2AIR, Mantry (FR)

( * ) Notice: Subject to any disclaimer, the term of this patent is extended or adjusted under 35 U.S.C. 154(b) by 388 days.

(21) Appl. No.: 18/556,439

(22) PCT Filed: Apr. 21, 2022

(86) PCT No.: PCT/EP2022/060486
§ 371 (c)(1),
(2) Date: Oct. 20, 2023

(87) PCT Pub. No.: WO2022/223662
PCT Pub. Date: Oct. 27, 2022

(65) Prior Publication Data

US 2024/0183535 A1 Jun. 6, 2024

(30) Foreign Application Priority Data

Apr. 21, 2021 (FR) ..... 2104144

(51) Int. Cl.
*F23N 3/00* (2006.01)
*C10L 5/36* (2006.01)

(52) U.S. Cl.
CPC ..... *F23N 3/005* (2013.01); *C10L 5/363* (2013.01); *F23N 2239/02* (2020.01)

(58) Field of Classification Search
CPC ..... F23N 3/00; F23N 3/005; F23N 2239/02; C10L 5/363; C10L 5/368
See application file for complete search history.

(56) References Cited

U.S. PATENT DOCUMENTS

2002/0077722 A1 6/2002 Haraburda et al.
2010/0218419 A1* 9/2010 Bai ..... C10J 3/72 44/589

(Continued)

FOREIGN PATENT DOCUMENTS

EP 2085694 A2 8/2009
FR 3045659 A1 6/2017

OTHER PUBLICATIONS

International Search Report and Written Opinion issued on Jul. 26, 2022, in corresponding International Application No. PCT/EP2022/060486, 15 pages.

*Primary Examiner* — Ko-Wei Lin
(74) *Attorney, Agent, or Firm* — Maier & Maier, PLLC

(57) ABSTRACT

A method for regulating a wood burner that burns wood pellets. For a batch of pellets the method includes, determining the air flowrate and fuel flowrate parameters according to the levels of combustion of the pellets in a defined pellet-fired burner, creating at least one curve, identifying the optimal air and fuel parameters, recording these optimal parameters, the type of burner, the batch number, possibly extrapolating to other pellet-fired burners, recording these extrapolated optimal parameters, labelling each bag with information relating to these optimal parameters, when using a bag of pellets in a domestic pellet-fired burner, reading the information using reading means, and regulating the domestic burner by acting on regulating means that regulate the supply of air and fuel to the burner.

19 Claims, 2 Drawing Sheets

(56) References Cited

U.S. PATENT DOCUMENTS

| | | | | |
|---|---|---|---|---|
| 2014/0365381 | A1 | 12/2014 | Borowski et al. | |
| 2016/0169581 | A1 | 6/2016 | Kotyk | |
| 2020/0096195 | A1* | 3/2020 | Babington | F23D 11/00 |

* cited by examiner

METHOD FOR REGULATING A PELLET-FIRED BURNER AND CORRESPONDING INSTALLATION

FIELD

The technical field relates to domestic wood heating using a pellet-fired burner.

The technical field also relates to a method for improving domestic wood heating conditions using a pellet-fired burner.

BACKGROUND

It is known to use a burner as a means for domestic heating. Handling logs being tiring and tedious, it has been imagined to feed a burner with wood pellets, these pellets being burned in a combustion chamber also supplied with air. Wood pellets, also commonly known as "pellets", are small cylindrical sticks of compacted fuel. This type of pellet is produced mainly by pressing wood first and second processing byproducts (mainly softwood) but increasingly pulpwood with a high proportion of hardwoods.

Wood pellet-fired burners are efficient and ecological heating devices when they are properly regulated and supplied. There is the ISO 17225-2 standard or the EN 14961-2 standard which define some windows of technical characteristics of manufactured granules, like for example the volumetric mass of the pellets, the durability, the calorific power, the melting temperature of the ashes, their humidity level or the origin of the used wood. Given the significant variability in the characteristics of the raw material entering the factories, all these parameters allow for an almost infinite number of combinations.

Despite compliance with these standards, variations in the physicochemical qualities of wood may occur, due to the fact that wood is a living material which depends on numerous parameters, like for example the origin place or the growing conditions. The physicochemical characteristics of the pellets vary, as of leaving the same wood pellet production factory, depending on the raw material used as input. Indeed, while with crude oil, distilleries have to adapt the processes a little to ultimately provide an identical fuel everywhere on the same territory, this is much more complex with biomass.

This prevents pellet-fired burners from reaching the performance levels announced by their manufacturers and measured in the laboratory, in domestic use.

Indeed, unlike efficient and more expensive wood boilers, burners, simple pellet-fired and economical equipment, do not have an oxygen sensor and cannot adapt their parameters to fuel variations.

An oxygen probe, and possibly a carbon monoxide probe, also commonly called Lambda probe in the industry, is a small sensor located in the smoke outlet, at the boiler gas discharge. This probe measures the proportion of air and fuel in the unburnt gases following combustion in a wood boiler.

The oxygen probe, and possibly carbon monoxide probe, is intended to identify combustion errors, in particular the oxygen level. Depending on the obtained measurement, a computer or regulation controller of the boiler varies the primary and secondary air flow rates and the fuel flow almost in real-time, while maintaining maximum efficiency despite variations in requested power or fuel quality (density, humidity level, ash level, etc.).

Since pellet-fired burners do not include this oxygen probe, and possibly carbon monoxide probe, which is too expensive, it is known, during installation, that a professional installer proceeds with an accurate regulation of the primary and possibly secondary air flowrates and the flowrate of pellets in the burner. This regulation work guarantees the user of the domestic pellet-fired burner an efficiency and emissions of particles, nitrogen oxides, carbon monoxide, and other gases as expected by the manufacturer. To do so, the professional installer uses a mobile installation including specific and expensive probes. This intervention should be done upon installation of the pellet-fired burner but most often installers leave the factory settings.

The professional installer regulates the pellet-fired burner according to the pellets the user has in stock.

Yet, while a small fraction of households buys their pellets all at once, most households buy them in batches of a few bags, several times a month, sometimes even the pellet factory supply source changes. When the consumer changes supplier, or when the same brand supplies pallets of pellets originating from different factories, or simply when the pallet at the start of the season has been produced with a quite different raw material from the end-of-season pallet released from the same factory, the characteristics of the pellets change. Thus, a user uses different types of pellets. Hence, to ensure good combustion, the regulation of the pellet-fired burner should be checked and adjusted after each purchase of pellets, involving the professional installer, which is costly, requires expensive equipment and takes a long time that a user is not necessarily ready to pay.

This means that, for at least a significant part of the pellet-fired burner fleet, the initial or annual regulation no longer corresponds to the starting fuel and the performances of the installation is no longer there.

It also follows that, for a domestic pellet-fired burner, the burner has a lower efficiency, because it is unsuitable for the pellets actually used. Consequently, this causes excess fuel consumption of 5 to 10%. In addition, the burner becomes dirty more quickly, i.e. the glass gets dirty more quickly, the exchangers become covered with soot and the entire installation ages more quickly. Finally, an improper regulation of the air flowrate increases the amount of fine particles emitted by the equipment, which affects the quality of the ambient air.

Since the first commercialisation of this heating pellet-fired burner solution, in the 1970s, equipment manufacturers and pellet producers have passed the blame on each other. For the former, it is the quality of the fuel that is absent, for the latter, it is the equipment that is not efficient.

SUMMARY

The invention aims to provide a method for regulating a domestic pellet-fired burner so that it operates optimally even when changing wood pellets. This solution allows substantially reducing after-sales service costs for pellet producers and equipment manufacturers, while significantly improving air quality and reducing the energy bill of the end user.

The objective of the invention is also to propose an installation allowing adjusting a pellet-fired burner to new pellets with different physicochemical characteristics. Advantageously, this invention will allow solving the aforementioned problem concerning good adjustment of the combustion of wood pellets in a pellet-fired burner, in particular due to the change in the composition of the pellets. Indeed, due to the increase in demand for regular pellets which is in the range of 10 to 20% per year, it will be necessary to use more hardwood resources in the manufacture of pellets, which has not been the case to date.

In fact, the invention relates to a method for regulating the burner to the used pellets, and an installation enabling such a regulation. The invention also addresses the drawbacks of the prior art.

To this end, the invention relates to a method for regulating a wood pellet-fired burner, said method comprising the following steps:

- regularly determining, during the manufacture of a batch of bags of pellets, air flowrate and fuel flowrate parameters according to combustion levels of the pellets in a defined pellet-fired burner and a possibly corresponding power level,
- forming at least one curve indicating a combustion level and possibly a power level as a function of the air flowrate and fuel flowrate,
- identifying from this at least one curve the air flowrate and fuel flowrate parameters enabling a defined pellet optimal combustion level and possibly an optimal power level for a defined pellet-fired burner, this determination and identification being done with a defined burner equipped with means for measuring the combustion level and possibly the power level and means for measuring the air flowrate and fuel flowrate parameters,
- recording these optimal parameters and possibly this at least one curve, as well as the corresponding type of pellet-fired burner and a unique identification number of the corresponding batch of bags of pellets in a database, this recording being done with recording means,
- possibly also extrapolating to at least one other pellet-fired burner at least one curve and optimal parameters allowing guaranteeing the maximum efficiency of the combustion of defined pellets, and recording these optimal parameters, possibly this at least one extrapolated curve and the type of this other pellet-fired burner, in the database, in connection with the unique identification number of the corresponding batch of bags of defined pellets,
- marking on each bag of pellets of the corresponding batch information readable by a user of a pellet-fired burner with reading means allowing taking note of at least these optimal parameters of a defined or extrapolated type of pellet-fired burner,
- during the use of a registered bag of pellets by a user in a pellet-fired burner at the user's home, reading the information readable on the bag of pellets with reading means and taking note of the optimal parameters relating to his/her type of pellet-fired burner to ensure good combustion in his/her pellet-fired burner of these granules derived from a batch of bags of defined granules,
- regulating the of the user by acting on means for regulating the air and fuel supply of said burner, either by a manipulation by the user on the means for regulating the air and fuel supply of the burner, or, if these regulation means are coupled to the reading unit, by an automatic adjustment, so that the burner pellet operates according to the optimal parameters for an optimal combustion of defined pellets in the defined pellet-fired burner.

This method allows regulating a pellet-fired burner of a user to achieve an optimal combustion, according to the used defined pellet. By power level, it should be understood the thermal power released during the combustion of the pellets in the burner.

One feature of the method according to the invention is that reading of the information readable on the registered bag of pellets with reading means is followed by a display on a human-machine interface of the reading unit of the regulation data of a defined type of pellet-fired burner of the user, for optimal setting of the combustion of the pellets of said registered bag.

This allows transcribing the information marked on the bag in an intelligible manner in the form of regulation data readable directly by a user, so he/she could simply regulate his/her burner.

Another feature of the method according to the invention is that the regulation data contained in a database of a remote server are sent to the reading unit, following a request from the reading unit.

This allows keeping the data remotely and avoiding the data being stored only in the reading means.

Thus, data updates are simplified and the reading means can be manufactured simply and at a low cost.

Another feature of the method according to the invention alternative to the previous one is that the regulation data are computed from the information marked on the bag and from tables of values recorded in the reading unit.

On the contrary, this allows regulating one's pellet-fired burner in a place that cannot connect remotely to a server.

The invention also relates to an installation enabling the implementation of the previously-described method, said installation including:

- a pellet-fired burner equipped with means for measuring the combustion level and possibly the power level and means for measuring the air flowrate and fuel flowrate parameters, as well as means for forming at least one curve indicating the combustion level and possibly the power level as a function of the air flowrate and fuel flowrate, and means for identifying the optimal air flowrate and fuel flowrate parameters enabling a defined pellet optimal combustion level and possibly an optimal power level for a defined pellet-fired burner,
- possibly calculation and extrapolation means for extrapolating to other pellet-fired burners optimal parameters and possibly at least one curve allowing guaranteeing the maximum efficiency of the combustion of defined pellets,
- a server including a database and means for recording, in this database, these optimal parameters and possibly this at least one optimal curve, the type of used pellet-fired burner, as well that of the unique identification number of the corresponding batch of bags of pellets, and possibly optimal parameters and possibly at least one optimal curve extrapolated for a type of pellet-fired burner extrapolated for a unique identification number of a corresponding batch of bags of pellets,
- means of marking on each bag of pellets of the corresponding batch of information readable by a user of a burner with reading means,
- a reading unit including said reading means of a user of a domestic pellet-fired burner to read the information marked on each bag of pellets allowing taking note of at least these optimal parameters for a type of pellet-fired burner defined or extrapolated in the form of regulation data,
- means for regulating the air and fuel supply of a domestic pellet-fired burner of a user, said regulation means could be manipulated by the user to apply the optimal parameters to said burner or said regulation means could automatically adjusting the burner to apply the optimal parameters to said burner if said reading unit is coupled to said regulation means.

According to a feature of the invention, the installation includes means for transmitting and receiving a signal between the server and the reading unit.

This enables the reading unit to receive the regulation data of the pellet-fired burner of the user from the server.

According to a feature of the invention alternative to the previous feature the reading unit includes processing processes capable of calculating the regulation data from the information marked on a bag of pellets.

According to a feature of the invention, the information marked on a bag of pellets are marked in the form of a bar code, in particular a two-dimensional one.

BRIEF DESCRIPTION OF THE FIGURES

Other aims and advantages of the present invention will become apparent from the following description, referring to the appended drawings illustrating exemplary embodiments and wherein.

DETAILED DESCRIPTION

Figure 1:
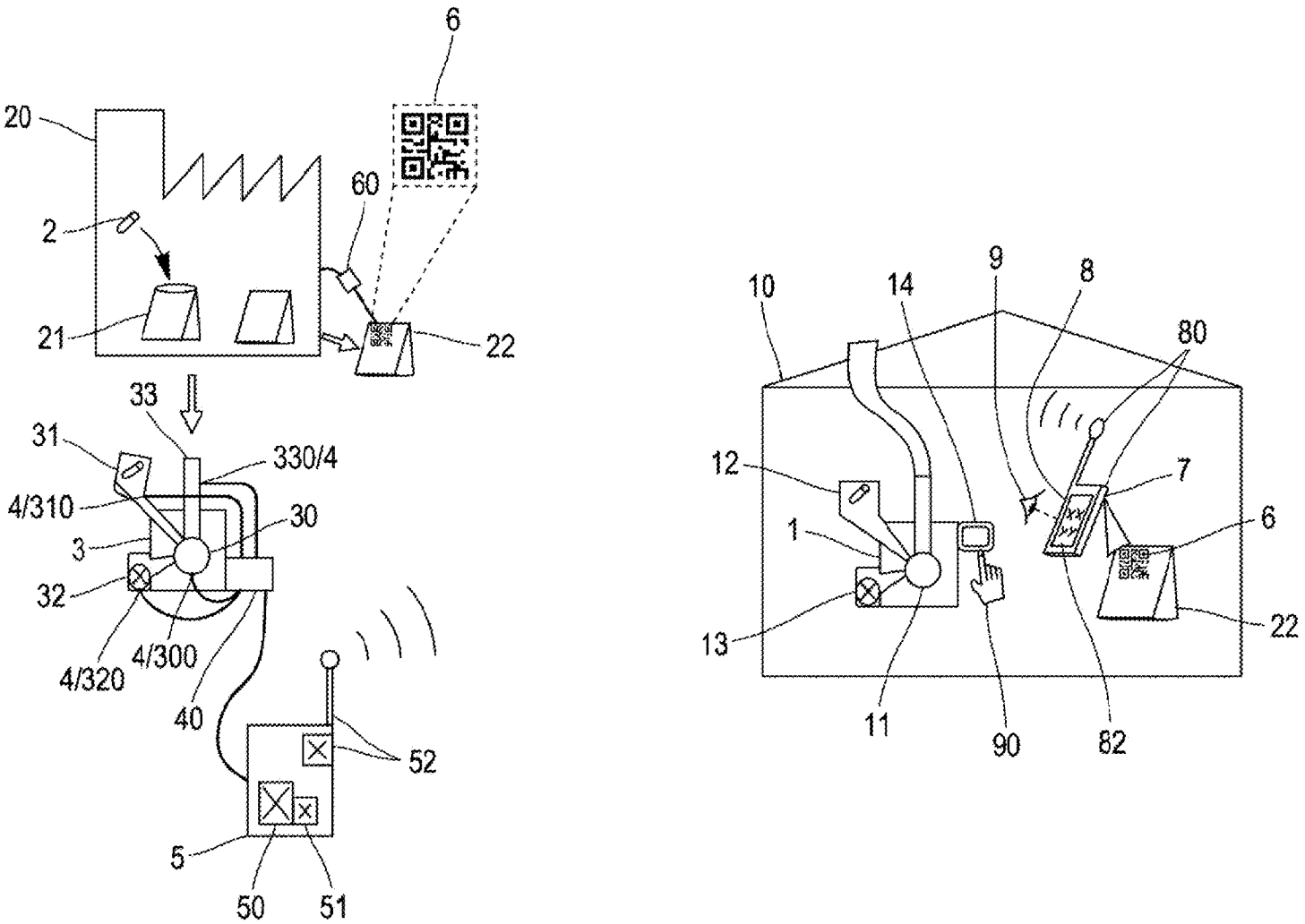
FIG. 1 is a schematic view of an installation according to an embodiment of the invention, enabling the implementation of the method for regulating a domestic pellet-fired burner of a user according to the invention.

The invention relates to a method for regulating a domestic wood pellet-fired 2 burner 1 in the home 10 of a user. This method is implemented using an installation described hereinafter.

This method enables a regulation of said burner 1 during the combustion of wood pellets 2. These wood pellets 2 are manufactured in batches in a factory 20 and are stored in bags 21. The factory 20 may be part, or not, of the installation. A unique identification number is assigned to each batch.

A small amount of pellets 2 from a defined batch, in the range of one kilogram for example, is used in a defined so-called reference pellet-fired burner 3 forming part of the installation. This reference pellet-fired burner 3 includes a combustion area 30; it also includes granules 2 supply means 31 for example in the form of a conduit adapted to be filled with granules, crossed by a worm screw pushing the pellets 2 into the combustion area 30 at a variable flowrate, and defining a pellets 2 feed rate. This reference pellet-fired burner 3 also includes air supply means 32, for example in the form of a conduit connected to a fan capable of sending air into the combustion area 30 at a variable flowrate and defining an air supply flowrate.

This reference pellet-fired burner 3 further includes smoke evacuation means 33 for example in the form of an evacuation conduit derived from the combustion area 30.

But this reference pellet-fired burner 3 also includes a sensor 310 at the pellet 2 supply means 31 to measure the pellets 2 supply flowrate, a sensor 320 at the air supply means 32 to measure the air supply flowrate, and sensors 300, 330 respectively at the combustion area 30 and at the smoke evacuation means 33, to measure a combustion level of the granules 2 and possibly a released power level in the reference burner 3. These sensors form means 4 for measuring the combustion level and possibly the power level and the air flowrate and fuel flowrate parameters. These means 4 for measuring the combustion level and possibly the power level may include one or more probe (s) measuring in particular the oxygen and carbon monoxide levels. The reference burner 3 further includes a recording and calculation block 40, for example in the form of an electronic board connected to recording means in digital form in a database, this block 40 forming means for forming at least one curve indicating the combustion level and possibly the power level as a function of the air and fuel flowrates, and means for identifying the optimal air fuel flowrate parameters allowing an optimal combustion level of defined pellets and power level for a defined pellet-fired burner. In the case where the reference pellet-fired burner 3 has, in its domestic version, only predetermined regulation positions and values for regulating the air and fuel flow rates, the parameter identification means can select the optimal parameters relating to the possible predetermined regulation positions or values for said pellet-fired burner. The means for identifying the optimal parameters may include a computer implementing a process of decision and calculation of the optimal parameters with regards to the predetermined positions or values for regulating the possible air and fuel flowrates for said pellet-fired burner.

Once these optimal parameters have been obtained, they are sent, as well as possibly at least one corresponding measured curve, in a server 5 of the installation, and more particularly in a recording unit 50, for example in the form of data in a database.

This recording unit 50 records, in this database, also the type of the used reference pellet-fired burner 3, as well as the unique identification number of the corresponding batch of bags 21 of pellets 2.

The server 5 may also include a calculation unit 51 including a computer, capable of extrapolating, from the optimal parameters and/or at least one associated curve corresponding to the reference burner 3, optimal parameters and possibly at least one associated curve for another type of pellet-fired burner, and that being so for pellets originating from batches tested in the reference burner 3.

In the case where a type of pellet-fired burner extrapolated in its domestic version has only predetermined positions and regulation values for regulating the air and fuel flowrates, the calculation unit 51 can select the optimal air and fuel flowrate parameters for said pellet-fired burner type with regards to the predetermined positions or values for regulating the air and fuel flow rates possible for said pellet-fired burner type. The computer of the calculation unit 51 can implement a process of decision and calculation of the optimal parameters of said optimal pellet-fired burner type with regards to the predetermined positions or values for regulating the air and fuel flowrates possible for said pellet-fired burner type and information marked on the bag 21 of pellets 2.

To do so, the calculation unit 51 may implement an algorithm based on a statistical analysis of prior results, or on a correlation analysis previously carried out between a reference burner 3 and said other pellet-fired burner to be extrapolated. In this case, these extrapolated optimal parameters as possibly the at least one extrapolated curve are also recorded in the recording unit 50.

The recording unit 50 can also record an information string compiling the recorded data relating to a batch of bags 21 of pellets 2, i.e. for example the measured or extrapolated optimal parameters, the reference 3 or extrapolated burner type, etc. or simply a unique identification value of said recorded data relating to a batch of bags 21 of pellets 2.

The server 5 may then create information 6 for example in the form of a two-dimensional barcode, expressing the information string or the unique identification value described before, or part of the recorded data relating to a batch of bags 21 of pellets 2. This information 6 is then marked on each bag 21 of said batch by information marking means 60 of the installation. Bags 22 with information 6 marked therein are obtained, these bags 22 forming part of the installation. For example, the marking means 60 may be an inkjet print head or a laser engraving information 6 in the form of a bar code, for example two-dimensional, on the bag 21, here in the form of a QR code as illustrated in the figures.

The server 5 may include means for transmitting and receiving 52 a signal to/from other units of the installation, either by remote communication means as illustrated in [FIG. 1], or by wire means.

When the marked bag 22 arrives at the home 10 of a user, said user uses a reading unit 8 including reading means 7 allowing reading the information 6 marked on the marked bag 22.

The reading means 7 may include, in a known manner, an optical camera and means for processing the image of the images originating from said camera.

The home of this user includes a domestic wood pellet-fired burner 1 as part of the installation.

It has a combustion area 11, pellet 2 supply means 12, air supply means 13; this domestic pellet-fired burner 1 being identical, at least for the aforementioned elements 11, 12, 13, to the reference pellet-fired burner 3 or to a pellet-fired burner whose optimal parameters have been extrapolated.

This domestic wood pellet-fired burner 1 further includes means 14 for regulating the fuel and air supply flowrates.

The server 5 may include means 52 of transmitting and receiving a signal in particular to the reading unit 8 which also includes means 80 for transmitting and receiving a signal by remote communication means, as illustrated in [FIG. 1]. In fact, the installation may include means 52, 80 for transmitting and receiving a signal between the server 5 and the reading unit 8. The information 6 read on the marked bag 22 are then sent to the server 5 possibly with the type of the burner of the user, and in return the server 5 returns the regulation data suited to obtain optimal combustion for pellets 2 originating from a defined marked bag 22.

Figure 2:
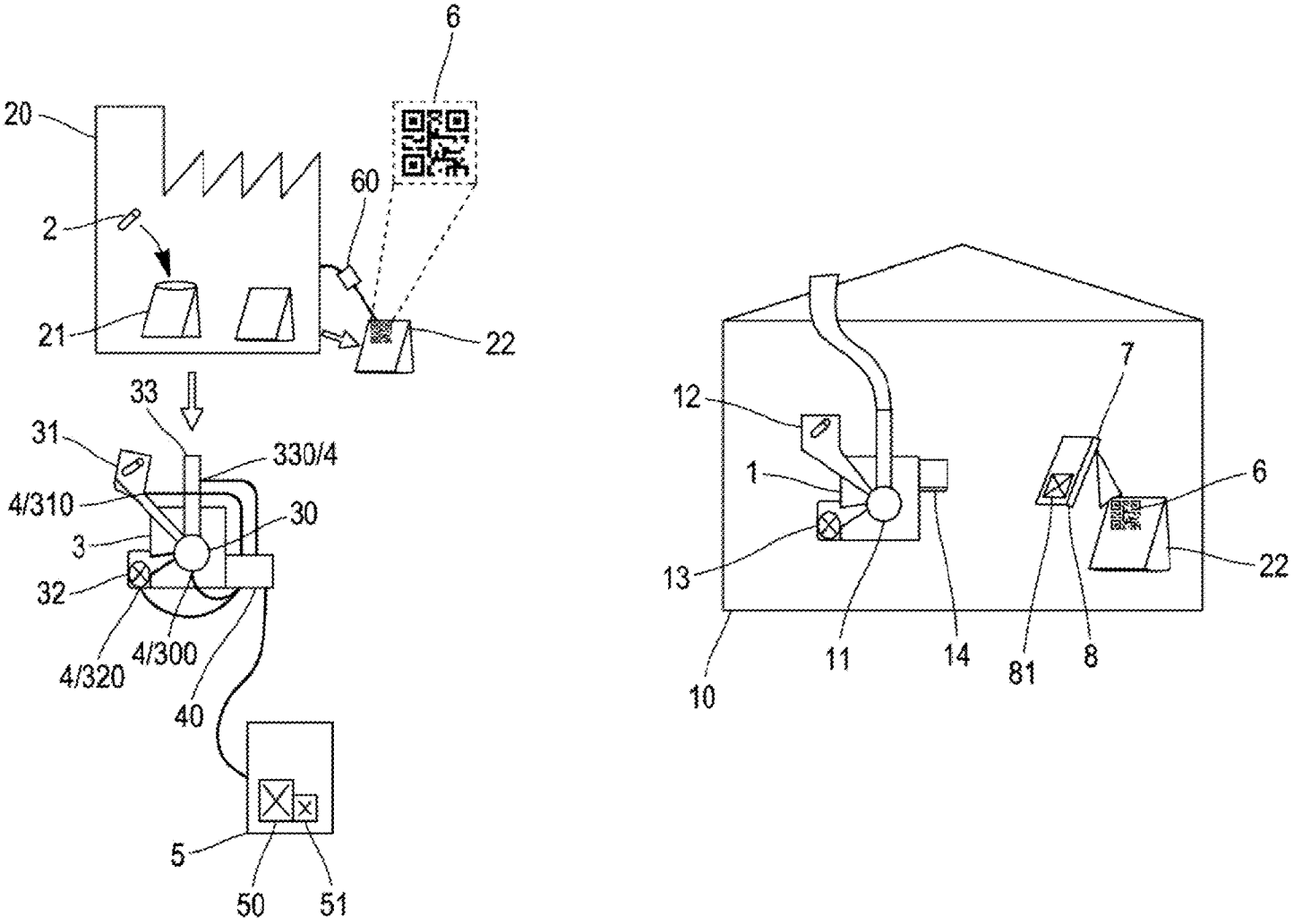
FIG. 2 is a schematic view of an installation according to another embodiment of the invention, enabling the implementation of the method for regulating a domestic pellet-fired burner of a user according to the invention.

Alternatively, the reading unit 8 includes a digital memory and a computer 81 allowing implementing processing processes capable of calculating the regulation data from the information 6 marked on a marked bag of pellets 22, as illustrated in [FIG. 2]. This calculation may be based on tables of predetermined values or look-up tables recorded in advance in the digital memory of the reading unit 8.

In the case where a type of pellet-fired burner has only predetermined regulation positions and values for regulating the air and fuel flow rates, the computer 81 of the reading unit 8 may calculate the regulation data by taking into account the possible predetermined regulation positions or values for said pellet-fired burner type. The computer 81 may implement a process of decision and calculations of the optimal regulation data of said pellet-fired burner type with regards to the predetermined regulation positions or values of the air and fuel flowrates possible for said pellet-fired burner type and the information marked on the bag of pellets.

Advantageously, the reading unit 8 may be a telephone including a camera function and an application enabling the processing of the images to read the information 6 marked on a marked bag 22, like for example a smartphone.

The regulation data, as illustrated in [FIG. 1], may be displayed on a human-machine interface 82 in the form of a screen. In which case the user reads the regulation data with his/her eyes 9 and activates the means 14 for regulating the air and fuel supply of his/her domestic burner 1 with his/her hand 90. Of course, the user may also control the regulation means 14 with a remote control according to an alternative embodiment which is not illustrated herein.

As illustrated in [FIG. 2], the reading unit 8 may also be coupled to the means 14 for regulating the air and fuel supply of the domestic burner 1 by wired means. In this case, said regulation means 14 may be capable of automatically adjusting the burner to apply the optimal parameters and the regulation data to said burner, in particular by commands from the reading unit 8. The reading unit 8 may also be coupled to the adjustment means 14 by wireless communication means.

An installation as described before enables the implementation of the method according to the invention, following the steps described hereinafter:

- regularly determining, during the manufacture of a batch of bags 21 of pellets 2, air flowrate and fuel flowrate parameters according to combustion levels of the pellets 2 in a defined pellet-fired burner 3 and a corresponding power level,
- forming at least one curve indicating a combustion level, and possibly a power level, as a function of the air flowrate and fuel flowrate,
- identifying from this at least one curve the air flowrate and fuel flowrate parameters enabling a defined pellet 2 optimal combustion level and possibly an optimal power level for a defined pellet-fired burner 3, this determination and this identification being done with a defined burner 3 equipped with means for measuring 300, 330 the combustion level and possibly the power level and means for measuring the air flowrate 320 and fuel flowrate 310 parameters,
- recording these optimal parameters and possibly this at least one curve, as well as the corresponding type of pellet-fired burner 3 and a unique identification number of the corresponding batch of bags 21 of pellets 2 in a database, this recording being done with recording means 50,
- possibly also extrapolating to at least one other pellet-fired burner at least one curve and optimal parameters allowing guaranteeing the maximum efficiency of the combustion of defined pellets 2, and recording these optimal parameters, possibly this at least one extrapolated curve and the type of this other pellet-fired burner, in said database, in connection with the number of the corresponding batch of bags 21 of defined pellets 2,
- marking on each bag 21 of pellets 2 of the corresponding batch information 6 readable by a user of a pellet-fired burner 1 with reading means 7 allowing taking note of at least these optimal parameters of a defined or extrapolated type of pellet-fired burner 3,
- during the use of a marked bag of pellets 2 by a user in a pellet-fired burner 1 at the user's home, reading the information 6 readable on the marked bag of pellets 22 with reading means 7 and taking note of the optimal parameters relating to his/her type of pellet-fired burner 1 to ensure good combustion in his/her pellet-fired burner 1 of these granules 2 derived from a batch of bags 22 of defined granules 2,
- regulating the 1 of the user by acting on means 14 for regulating the air and fuel supply of said burner 1, or by a manipulation by the user on said means 14 for regulating the air and fuel supply of the burner 1, or, if these regulation means 14 are coupled to the reading unit 8, by an automatic adjustment, so that the burner pellets 1 operates according to the optimal parameters for an optimal combustion of defined pellets 2 in the pellet-fired burner 1 of the user. The automatic adjustment may be done by exchanges between the regulation means 14 and the reading unit 8, which allows comfort and simplicity of use while avoiding risks of regulation error due to an intervention by the user.

Reading the information 6 readable on the marked bag of pellets 22 with reading means 7 is possibly followed by a display on a human-machine interface 82, and more particularly on a screen of the reading unit 8 of the regulation data of a defined type of pellet-fired burner 1 of the user, for an optimal configuration of the combustion of the pellets 2 of said bag 22.

The regulation data contained in a database of a remote server 5 are possibly sent to the reading unit 8, and more particularly following a request from said reading unit 8.

Alternatively, the regulation data are computed from the information 6 marked on the bag 22 and from tables of values recorded in the reading unit 8.

Thus, with this method and this installation, each domestic pellet-fired burner is virtually equipped with a CO and O2 probe to better adapt the settings of said burners to the burned pellets, making said burners more efficient and upgrading them to the level of high-performance boilers.

The invention claimed is:

1. A method for regulating a wood pellet fired burner, said method comprising the following steps:

regularly determining, during manufacture of a batch of bags of pellets, an air flowrate parameter and a fuel flowrate parameter according to combustion levels of the pellets in a defined pellet-fired burner and a corresponding power level;

forming at least one curve indicating a combustion level as a function of the air flowrate and fuel flowrate;

identifying, from the at least one curve, an optimal air flowrate parameter and an optimal fuel flowrate parameters enabling a defined pellet optimal combustion level for a defined pellet-fired burner, the determining step and the identifying step being done with a defined burner equipped with means for measuring the combustion level, and with means for measuring the air flowrate parameter and the fuel flowrate parameters;

recording, in a database, the optimal air flowrate parameter, the optimal fuel flowrate parameter, and the at least one curve, as well as the corresponding type of pellet-fired burner and a unique identification number of the corresponding batch of bags of pellets, the recording being done with a recording means;

recording, in the database, the optimal air flowrate parameter, the optimal fuel flowrate parameter, and the type of the other pellet-fired burner, in connection with the unique identification number of the corresponding batch of bags of defined pellets;

marking, on each bag of pellets of the corresponding batch, information readable, by a user of a pellet-fired burner, with a reading means allowing taking note of at least the optimal air flowrate parameter and the optimal fuel flowrate parameter of a defined or extrapolated type of pellet-fired burner;

during use of a marked bag of pellets, by the user, in a pellet-fired burner at the user's home, reading the information readable on the bag of pellets with the reading means and taking note of the optimal air flowrate parameter and the optimal fuel flowrate parameter relating to the user's type of pellet-fired burner to ensure good combustion, in the user's pellet-fired burner, of the pellets derived from a batch of bags of defined pellets; and regulating the pellet-fired burner of the user by acting on a regulation means for regulating the air and fuel supply of said burner, either by a manipulation by the user on said regulation means, or, if said regulation means are coupled to a reading unit, by an automatic adjustment, so that the pellet-fired burner operates according to the optimal air flowrate parameter and the optimal fuel flowrate parameter for an optimal combustion of the defined pellets in the defined pellet-fired burner.

2. The regulation method according to claim 1, wherein reading of the information readable on the marked bag of pellets with the reading means is followed by displaying, on a human-machine interface of the reading unit, regulation data of a defined type of pellet-fired burner of the user, for optimal setting of the combustion of the pellets of said marked bag.

3. The regulation method according to claim 1, wherein the regulation data contained in a database of a remote server are sent to the reading unit, following a request from the reading unit.

4. The regulation method according to claim 1, wherein the regulation data are computed from the information marked on the bag and from tables of values recorded in the reading unit.

5. An installation enabling the implementation of the method according to claim 1, said installation including:

a pellet-fired burner equipped with means for measuring the combustion level, the air flowrate parameter, and the fuel flowrate parameter, as well as with means for forming at least one curve indicating the combustion level as a function of the air flowrate and fuel flowrate, and with means for identifying the optimal air flowrate parameter and the optimal fuel flowrate parameters enabling a defined pellet optimal combustion level;

a server including the database and means for recording, in the database, the optimal air flowrate parameter, the optimal fuel flow rate parameter, and the type of used pellet-fired burner, as well as the unique identification number of the corresponding batch of bags of pellets;

means of marking, on each bag of pellets, the corresponding batch of information readable by a user of a burner with a reading means;

a reading unit, including said reading means, of the user of the pellet-fired burner to read the information marked on each marked bag of pellets allowing taking note of at least the optimal parameters for the type of pellet-fired burner defined or extrapolated in the form of regulation data;

the regulation means for regulating the air and fuel supply of the pellet-fired burner of the user, said regulation means being manipulatable by the user to apply the optimal parameters to said burner, or said regulation means automatically adjusting the burner to apply the optimal parameters to said burner if said reading unit is coupled to said regulation means.

6. The installation according to claim 5, further comprising means for transmitting and receiving a signal between the server and the reading unit.

7. The installation according to claim 5, wherein the reading unit is configured to calculate the regulation data from the information marked on a marked bag of pellets.

8. The installation according to claim 5, wherein the information marked on a marked bag of pellets is marked in the form of a bar code.

9. The regulation method according to claim 1, wherein the at least one curve indicating the combustion level is formed as a function of the air flowrate and fuel flowrate and a corresponding power level.

10. The regulation method according to claim 1, further comprising identifying, from the at least one curve, an optimal power level for the defined pellet-fired burner.

11. The regulation method according to claim 1, wherein the determining step and the identifying step are done with the defined burner equipped with means for measuring the combustion level and the power level.

12. The regulation method according to claim 1, further comprising recording, in the database, the at least one curve along with the optimal air flowrate parameter and the optimal fuel flowrate parameter.

13. The regulation method according to claim 1, further comprising, after the first recording step, extrapolating, to at least one other pellet-fired burner, the at least one curve, the optimal air flowrate parameter, and the optimal fuel flowrate parameter allowing guaranteeing a maximum efficiency of combustion of defined pellets.

14. The regulation method according to claim 13, further comprising recording, in the database, the at least one extrapolated curve in connection with the unique identification number of the corresponding batch of bags of defined pellets.

15. The installation according to claim 5, wherein the pellet-fired burner is further equipped with means for measuring the power level.

16. The installation according to claim 5, wherein the pellet-fired burner is equipped with means for forming at least one curve indicating the combustion level and the power level as a function of the air flowrate and fuel flowrate.

17. The installation according to claim 5, wherein the pellet-fired burner is further equipped with means for identifying the optimal air flowrate parameter and the optimal fuel flowrate parameter enabling an optimal power level for a defined pellet-fired burner.

18. The installation according to claim 5, further comprising calculation and extrapolation means for extrapolating, to other pellet-fired burners, the optimal air flowrate parameter, the optimal fuel flowrate parameter and the at least one curve allowing guaranteeing the maximum efficiency of the combustion of defined pellets.

19. The installation according to claim 5, further comprising means for recording, in the database, the at least one optimal curve, as well as the optimal parameters and the at least one optimal curve extrapolated for at least one of a type of pellet-fired burner extrapolated for a unique identification number of a corresponding batch of bags of pellets.

* * * * *